US009345278B2

(12) United States Patent
Crear et al.

(10) Patent No.: US 9,345,278 B2
(45) Date of Patent: May 24, 2016

(54) GLOVE FOR MEAT PREPARATION

(71) Applicants: Zachary Ryan Crear, Santa Monica, CA (US); Jesse Michael Langridge, Kailua Kona, HI (US)

(72) Inventors: Zachary Ryan Crear, Santa Monica, CA (US); Jesse Michael Langridge, Kailua Kona, HI (US)

( * ) Notice: Subject to any disclaimer, the term of this patent is extended or adjusted under 35 U.S.C. 154(b) by 0 days.

(21) Appl. No.: 14/062,876

(22) Filed: Oct. 24, 2013

(65) Prior Publication Data

US 2015/0113703 A1 Apr. 30, 2015

Related U.S. Application Data

(60) Provisional application No. 61/718,951, filed on Oct. 26, 2012.

(51) Int. Cl.

*A41D 19/015* (2006.01)
*A41D 19/00* (2006.01)
*B26B 27/00* (2006.01)

(52) U.S. Cl.

CPC ..... *A41D 19/0024* (2013.01); *A41D 19/01529* (2013.01); *A41D 19/01594* (2013.01); *B26B 27/007* (2013.01); *A41D 2600/20* (2013.01)

(58) Field of Classification Search

CPC ... A41D 19/00; A41D 19/002; A41D 19/055; A41D 19/01529; A41D 19/01547
USPC ..... 2/159, 160, 161.6, 161.8, 163
See application file for complete search history.

(56) References Cited

U.S. PATENT DOCUMENTS

| | | | | |
|---|---|---|---|---|
| 137,918 | A * | 4/1873 | Harts | 30/123.5 |
| 666,666 | A * | 1/1901 | Hackett | 30/175 |
| 885,569 | A * | 4/1908 | Bergquist | 30/298 |
| 1,642,311 | A * | 9/1927 | Richardson | 56/328.1 |
| 2,409,101 | A | 10/1946 | Brittingham | |
| 3,593,803 | A * | 7/1971 | Ibach | 172/10 |
| 4,149,601 | A | 4/1979 | Taylor | |
| 4,867,246 | A | 9/1989 | Kiger | |
| 4,976,032 | A * | 12/1990 | Battaglia | 30/298 |
| 5,325,596 | A * | 7/1994 | Baker | 30/298 |
| 5,644,796 | A * | 7/1997 | Laughlin | 2/161.6 |
| 5,881,388 | A | 3/1999 | Pratt | |
| 6,298,489 | B1 * | 10/2001 | Cox | 2/161.6 |
| 6,408,441 | B1 * | 6/2002 | Smith et al. | 2/161.6 |
| 6,457,182 | B1 * | 10/2002 | Szczesuil et al. | 2/161.6 |
| 6,460,190 | B1 * | 10/2002 | Blum | 2/158 |
| D513,827 | S | 1/2006 | Ward | |
| 7,055,177 | B2 * | 6/2006 | Svrcek | 2/21 |
| D581,127 | S * | 11/2008 | Bautista et al. | D2/617 |
| 8,281,416 | B1 * | 10/2012 | Smith | 2/161.6 |
| 8,458,817 | B1 * | 6/2013 | Babb | 2/163 |
| 2007/0266475 | A1 * | 11/2007 | Frazier et al. | 2/161.1 |
| 2009/0077704 | A1 * | 3/2009 | Duncan et al. | 2/16 |
| 2009/0139010 | A1 * | 6/2009 | Bevier | 2/161.8 |
| 2011/0030121 | A1 * | 2/2011 | Smalls | 2/161.7 |
| 2013/0019367 | A1 * | 1/2013 | Lasci | 2/20 |
| 2013/0139293 | A1 * | 6/2013 | Takashima | 2/163 |
| 2013/0291281 | A1 * | 11/2013 | Lee et al. | 2/160 |
| 2014/0245517 | A1 * | 9/2014 | Henry et al. | 2/16 |

* cited by examiner

*Primary Examiner* — Anna Kinsaul
*Assistant Examiner* — Jocelyn Wu
(74) *Attorney, Agent, or Firm* — Raj S. Aujla

(57) ABSTRACT

A glove for meat preparation. A variety of cutting elements are attached to the glove's thumb and fingers and allow the user to cut, care, shred slice or trim hot meat. The glove allows the user to handle the meat and also protects the user's hand from the meat's high temperature after cooking, broiling grilling or smoking.

2 Claims, 9 Drawing Sheets

GLOVE FOR MEAT PREPARATION

CROSS-REFERENCE TO RELATED APPLICATION

This application claims the benefit of U.S. Provisional Application No. 61/718,951, filed Oct. 26, 2012.

FIELD OF THE INVENTION

The present invention relates in general to a glove, and more specifically, to the elements of a glove for meat and food preparation.

COPYRIGHT & TRADEMARK NOTICE

A portion of the disclosure of this patent application may contain material that is subject to copyright protection. The owner has no objection to the facsimile reproduction by any one of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and shall not be construed as descriptive or to limit the scope of this invention to material associated only with such marks.

BACKGROUND OF THE INVENTION

When meat is prepared, it is ideal to serve it immediately. Take the meat out of the oven, cut it and serve. Depending on the size of the meat, problems arise when attempting to handle, cut, slice, carve and/or shred the meat for consumption. Some meats may be cooked whole, for example poultry and seafood. Other meats are cooked in large cuts, for example pork and beef.

One method to prepare the meat is to use a fork to hold it and a knife to cut, slice or carve the meat. This is difficult, time consuming and inefficient. By the time the meat is cut, sliced or carved and ready for consumption, however, it has cooled past its optimal eating temperature and lost its freshness, often requiring re-heating and change in flavor.

An alternative method is the use of hands. But this also has its disadvantages. The temperature of the meat is too hot to touch with bare hands resulting in burns to the skin. Compounding the problem is the slipperiness of the meat to hold with hare hands. Also, there is an issue of sanitation when one uses then hare hands to handle the meat and serve it to their guests. The prior art of food preparation gloves do not provide the necessary protection from the heat or prevent the meat from slipping.

SUMMARY OF THE INVENTION

The present invention is directed to a device that satisfies this need of preparing, which includes, but is not limited to, handling, cutting, slicing, shredding, carving, chopping, dicing, shaving, or trimming meat. The meat glove device has been conceived that comprises a full handed glove covering the wrist, hand, digits and includes a cutting element that may be attached to one or more of the distal terminus of the glove's digital portions. The device also includes a gripping element that may be located on the palmer surface of the glove's digital portions. Also included is a ring located near each joint of the palm and digits. The body of the glove, itself, is made of material that is resistant to heat, water, bacteria and virus.

Additionally, a device comprising a full handed glove covering the wrist, hand, digits and cutting element that may be attached to one or more the distal terminus of the glove's digital portions. The top cutting element may be removed from the bottom cutting element and interchangeable with a variety of different top cutting elements. The device also includes a gripping element that may be located on the palmer surface of the glove's digital portions. Also included is a ring located near each joint of the palm and digits. The body of the glove, itself, is made of material that is resistant to heat, water, bacteria and virus.

Additionally, a method for using the device to prepare meat comprising, wearing the device, utilizing the cutting element to prepare the meat and using the fingertip grips to secure the meat.

It is an objective of the present invention to handle, cut, slice, shred, carve, chop, dice, shave or trim meat easily and quickly, thereby minimizing the time it takes to prepare meat for a meal before any significant decrease in temperature of the meat.

It is another objective of the present invention to handle, cut, slice, shred, carve, chop, dice, shave or trim meat efficiently without the use of multiple tools, thus decreasing the amount of clean up required after preparing the meat.

It is another objective of the present invention to provide comfort as well as allow easy ingress and egress of the digits into the digit compartments.

It is another objective of the present invention to secure the meat during preparation.

It is yet another objective of the present invention to provide protection to the bare hand from the high temperature of the meat.

It is yet another objective of the present invention to allow the device to be laundered easily without compromising the integrity of the device.

Finally, it is yet another objective of the present invention to promote sanitary conditions while preparing the meat for consumption.

These and other advantages and features of the present invention are described herein with specificity so as to make the present invention understandable to one of ordinary skill in the art.

BRIEF DESCRIPTION OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention.

FIG. 5(*c*) is a side perspective view of an exemplary embodiment of the principles of the invention.

DETAILED DESCRIPTION OF THE DRAWINGS

In the following discussion that addresses a number of embodiments and applications of the present invention, reference is made to the accompanying, drawings that form a part hereof where depictions are made, by way of illustration, of specific embodiments in which the invention may be practiced. It is to be understood that other embodiments may be utilized, and changes may be made without departing from the scope of the present invention.

In today's busy life, the question always arises what to eat for lunch or dinner. Convenience and quality are key considerations. Some people may choose to purchase meats fully cooked and take them home. When home they may have to cut, slice, carve and/or shred the meat before eating. Many grocery stores, membership warehouse stores and convenience stores sell large cuts of cooked meat. These meats may include poultry, seafood, beef, and pork. An example is whole rotisserie chickens, which are typically maintained at high temperatures even after being cooked. Often the packaging containing the chicken is too hot for the consumer to hold with their bare hands for more than a few minutes. And the chicken inside the packaging is hotter.

Others may prefer to cook the meat themselves. These meats can be cooked in a variety of methods, for example, grill, sauté, roast, sear, hail, broil, barbeque or smoke. When the meat is ready it can be extremely hot and cannot be handled with bare hands.

Yet others may prefer visiting a restaurant where meats are cooked by various methods. Once the meat is folly cooked and ready for preparation, it is often too hot to handle with bare hands or with disposable food preparation gloves.

The present invention provides assistance in the preparation of meat. Preparation includes, but not limited to, handling, cutting, slicing, shredding, carving, chopping, dicing, shaving or trimming of meat.

Figure 1:
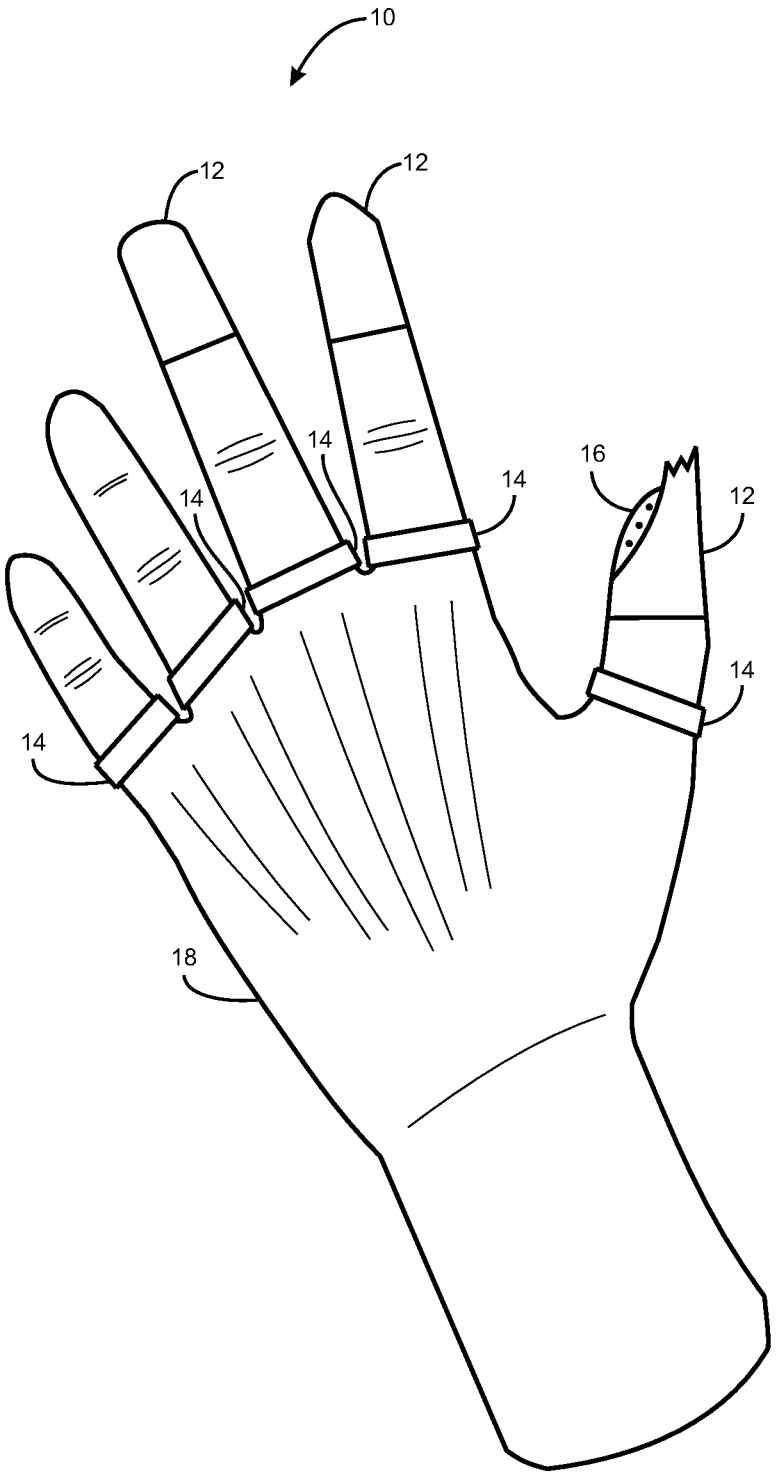
FIG. 1 is a top perspective view of a device embodying the principles of the invention.

As set forth above, FIG. 1 is a top perspective view of a device embodying the principles of the invention.

In an exemplary embodiment, the present invention having glove 10 including dorsal surface 18, cutting element 12, channel ring 14 and fingertip grips 16. Dorsal surface 18 may cover the hand from the distal terminus of the digits to the forearms. The material of glove 10 may be composed of a variety of natural or synthetic materials including, but not limited to, rubber, vinyl, canvas or polyester. The material should provide flexibility during use. Additionally, the material should be resistant to heat emanating from the meat. The material should be water resistant for laundering and repel any fluids that may flow from the meat. Further, the material should also be resistant to bacteria and viruses to prevent transferring any such pathogens to and from the meat.

Cutting element 12 may be comprised of any material durable enough to cut, slice, shred, carve, chop, dice, shave, pierce, or trim meat and maintain its rigidness. Cutting element 12 may be comprised of any number of materials including, but not limited to, plastics, rubber, metal, metal alloys, ceramics or wood or any combination thereof. In the exemplary embodiment, cutting element 12 may be comprised of plastic.

Cutting element 12 may be attached to glove 10 by adhesive, snaps, buttons, hook and loop or fashioned otherwise during the manufacturing process.

The distal ends of cutting element 12 may come in a variety of designs. As way of illustration, duck-billed cutting element 42 may extend beyond the distal terminus of the digital portion of glove 10 and form a shallow curve forming a duck-billed sharp edge. In another illustration, tapered cutting element 44 may extend beyond the distal terminus of the digital portion of glove 10 and taper to a sharp edge. In another illustration, serrated cutting element 40 may extend beyond the distal terminus of the digital portion of glove 10 with a serrated edge. In yet another illustration, cutting element 12 may contain several narrow times extending beyond the distal terminus of the digital portion of glove 10.

Cutting element 12 may be attached to glove 10 in various configurations. Cutting element 12 may be attached to each digit or attached to selected digits. The various designs of cutting element 12 are not limited to any specific order or digit. In an exemplary embodiment, serrated cutting element 40 may be attached to the thumb, tapered cutting element 44 may be attached to the index finger and a duck-billed cutting element 42 may be attached to middle finger.

As way of illustration for the variety of configurations, tapered cutting element 44 may be attached to the small finger, a duck-billed sharp edge cutting element 42 may be attached to the ring finger, a serrated edge cutting element 40 may be attached to the middle finger, a duck-billed sharp edge cutting element 42 may be attached to the index finger and a tapered sharp edge cutting element 44 may be attached to the thumb.

In an exemplary embodiment, channel ring 14 may be attached at the joint area of the digits and dorsal surface 18 and palmar surface 20 of glove 10. Channel ring 14 may be constructed of a variety of materials including, but not limited to, rubber, plastic, metal and metal alloys or any combination thereof. The material of channel ring 14 should maintain a permanent opening into the digit compartment of glove 10.

Figure 2:
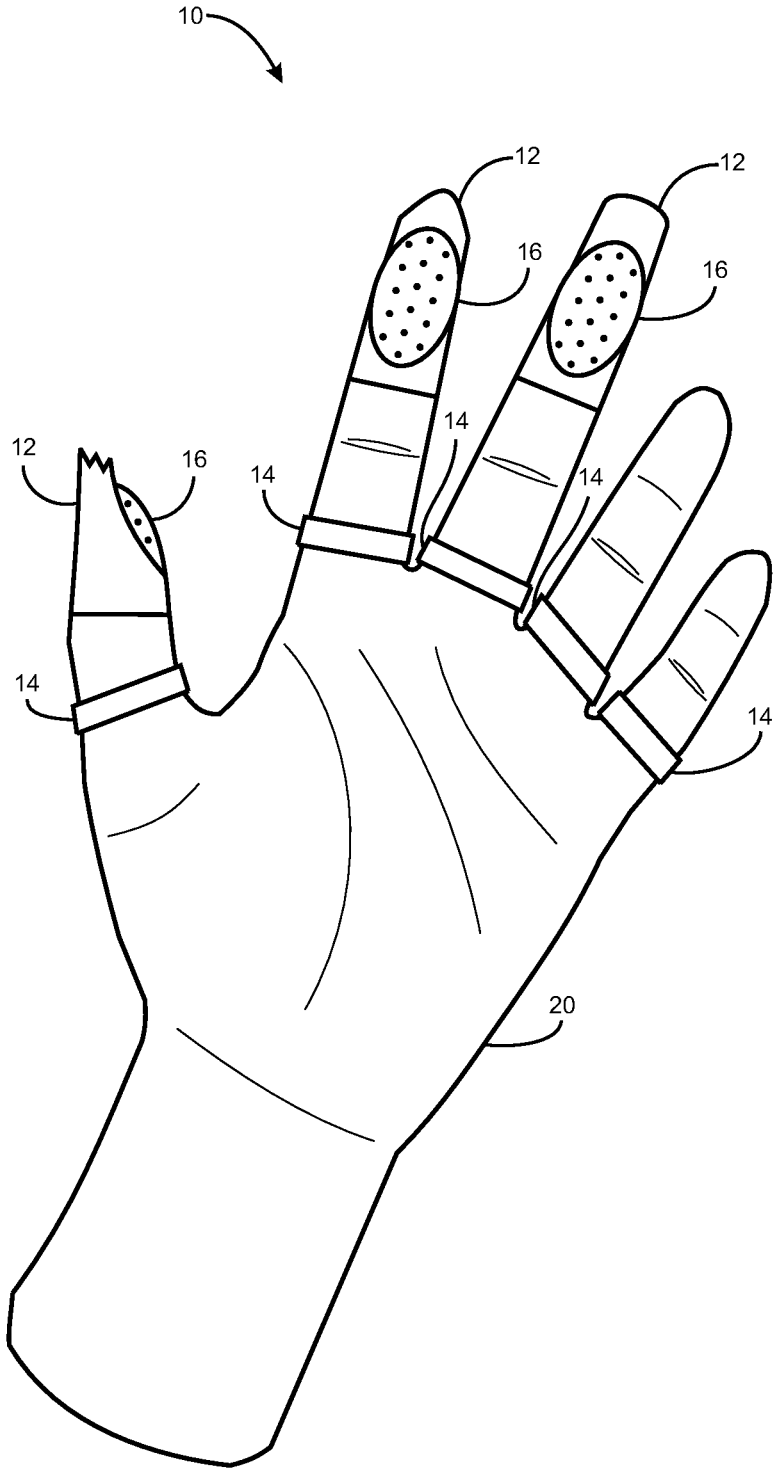
FIG. 2 is a bottom perspective view of a device embodying the principles of the Invention.

As set forth above, FIG. 2 is a bottom perspective view of a device embodying the principles of the invention.

In art exemplary embodiment, the present invention having glove 10 including palmar surface 20 and fingertip grip 16. Palmer surface 20 may cover the distal terminus of the digits to the forearms. Fingertip grip 16 provides glove 10 with a gripping element to secure the meat during preparation. Fingertip grip 16 prevents the neat from slipping out of glove 10. Fingertip grip 16 may be made from a variety of materials. As way of illustration, without limiting the invention, it may be a rubber pad attached to the fingertip or it may the same material as glove 10 that may be adhesive in nature when in contact with moisture.

Figure 3:
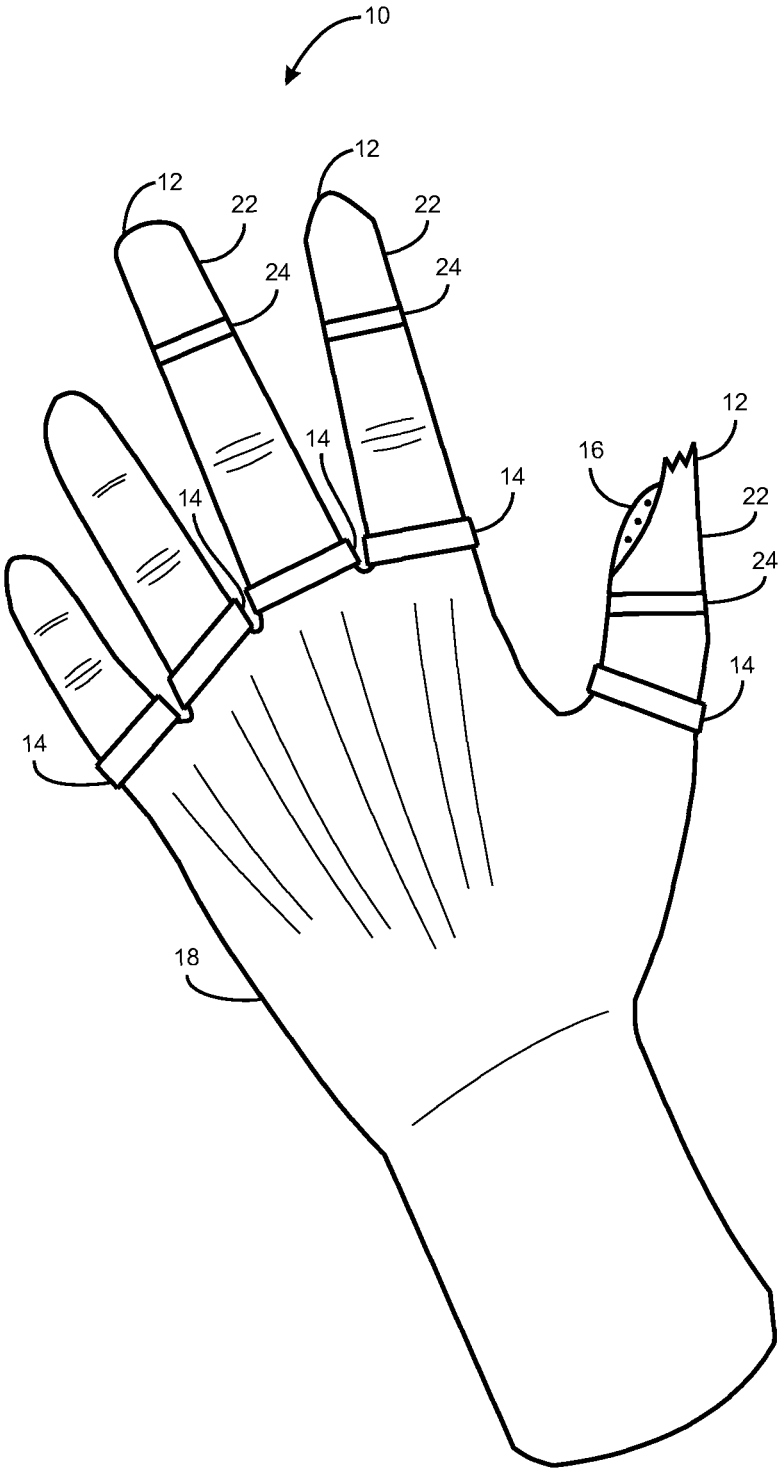
FIG. 3 is a top perspective view of a device embodying the principles of the Invention.

As set forth above, FIG. 3 is a top perspective view of a device embodying the principles of the invention.

In an alternative embodiment, the present invention having glove 10 including dorsal surface 18, top cutting element 22, bottom cutting element 24, channel ring 14 and fingertip grips 16. Dorsal surface 18 may cover the hand from the distal terminus of the digits to the forearms. The material of glove 10 may be composed of a variety of natural or synthetic materials including, but not limited to rubber, vinyl, canvas or polyester. The material should provide flexibility during use. Additionally, the material should be resistant to heat emanating from the meat. The material should be water resistant for laundering and repel any fluids that may flow from the meat. Further, the material should also be resistant to bacteria and viruses to prevent transferring any such pathogens to and from the meat.

Top cutting element 22 may be removable from bottom cutting element 24. Bottom cutting element 24 may be attached to glove 10. Top cutting element 22 may be interchanged with another top cutting element 22. Top cutting element 22 may be attached to bottom cutting element 24 in a variety of methods. As way of illustration without limiting the invention, top cutting element 22 and bottom cutting element 24 may be interlocked by screwing or snapping. This allows easily replacing top cutting element 22 for the configuration that best suits the situation.

Top cutting element 22 may be comprised of any material durable enough to cut, slice, shred, carve, chop, dice, shave, pierce, or trim meat and maintain its rigidness. Top cutting element 22 and bottom cutting element 24 may be comprised of any number of materials including, but not limited to, plastics, rubber, metal, metal alloys, ceramics or wood or any combination thereof. In the exemplary embodiment, top cutting element 22 and bottom cutting element 24 may be comprised of plastic.

Figure 4:
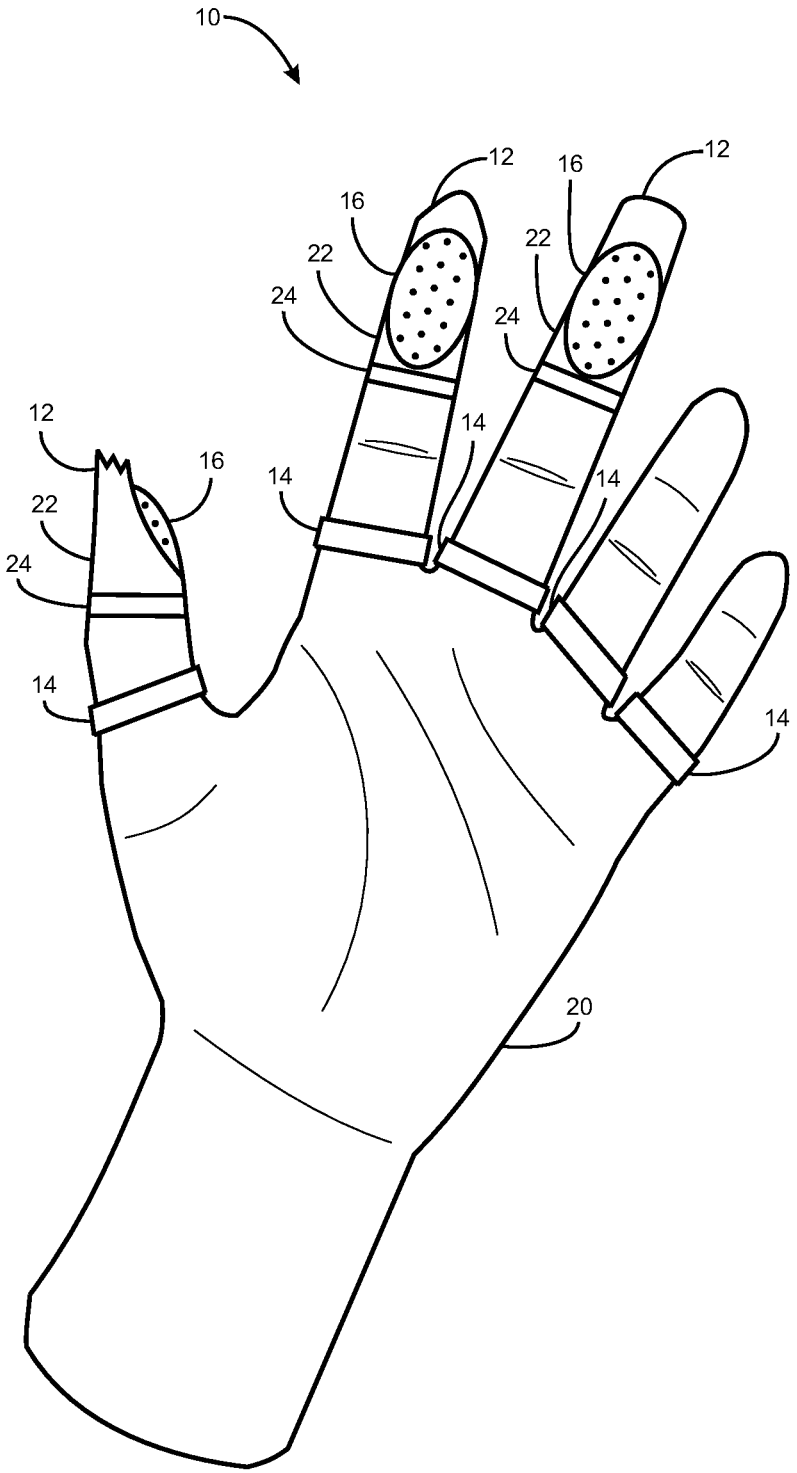
FIG. 4 is a bottom perspective view of a device embodying the principles of the invention.

As set forth above, FIG. 4 is a bottom perspective view of a device embodying the principles of the invention.

In an exemplary embodiment, the present invention having glove 10 including palmar surface 20 and fingertip grip 16. Palmer surface 20 may cover the distal terminus of the digits to the forearms. Fingertip grip 16 provides glove 10 with a gripping element to secure the meat during preparation. Fingertip grip 16 prevents the meat from slipping out of glove 10. Fingertip grip 16 may be made from a variety of materials. As way of illustration, without limiting the invention, it may be a rubber pad attached to the fingertip or it may the same material as glove 10 that may be adhesive in nature when in contact with moisture.

Figure 5A:
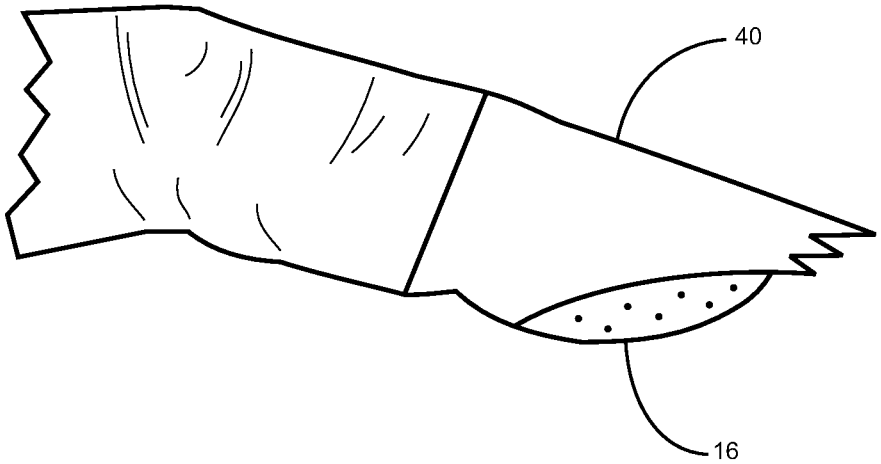
FIG. 5(*a*) is a side perspective view of an exemplary embodiment of the principles of the invention FIG. 5(*b*) is a side perspective view of an exemplary embodiment of the principles of the invention.
Figure 5B:
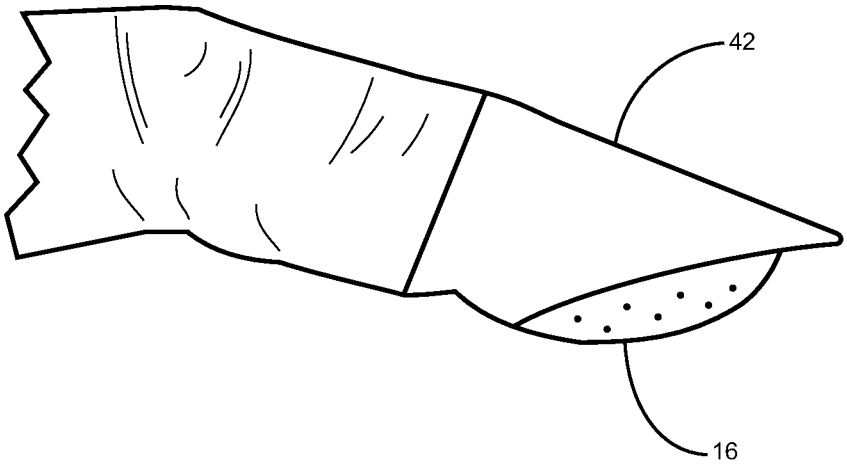
Figure 5C:
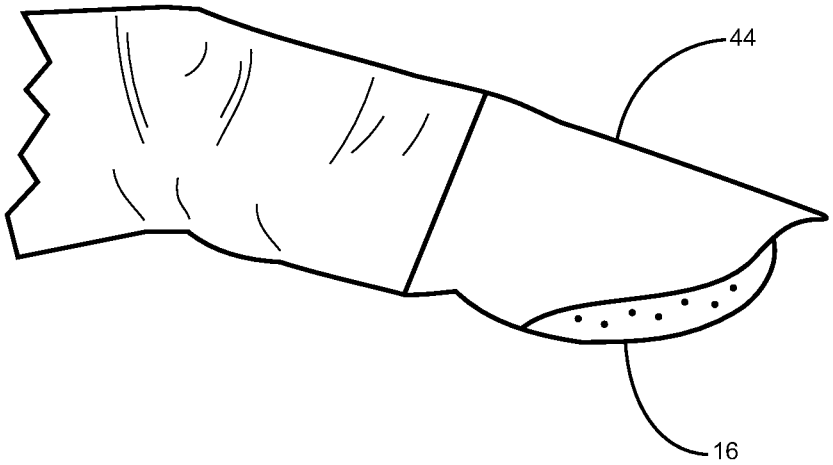

As set forth above, FIG. 5(*a*) is a side perspective view of a device embodying the principles of the invention.

Serrated cutting element 40 may extend beyond the distal terminus of digital portions of glove 10 with a serrated edge. Serrated cutting element 40 may be comprised of any number of materials including, but not limited to, plastics, metal, metal alloys, ceramics or wood or any combination thereof. In the exemplary embodiment, serrated cutting element 40 may be comprised of plastic.

As set forth above, FIG. 5(*b*) is a side perspective view of a device embodying the principles of the invention.

Duck-billed cutting element 42 may extend beyond the distal terminus of digital portion of glove 10 and form a shallow curve conning a duck-billed sharp edge. Duck-billed cutting element 42 may be comprised of any number of materials including but not limited to, plastics, rubber, metal, metal alloys, ceramics or wood or any combination thereof. In the exemplary embodiment, duck-billed cutting element 42 may be comprised of plastic.

As set forth above, FIG. 5(*c*) is a side perspective view of a device embodying the principles of the invention.

Tapered cutting element 44 may extend beyond the distal terminus of digital portion of glove 10 and taper to a sharp edge. Tapered cutting element 44 may be comprised of any number of materials including, but not limited to, plastics, rubber, metal, metal alloys, ceramics or wood or any combination thereof. In the exemplary embodiment, tapered cutting element 44 may be comprised of plastic.

Figure 6:
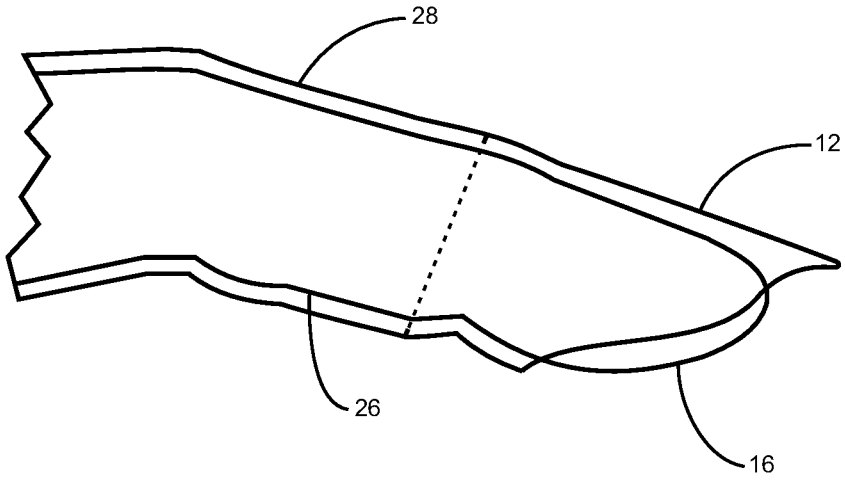
FIG. 6 is a cross-section perspective view of a device embodying the principles of the invention.
Figure 7:
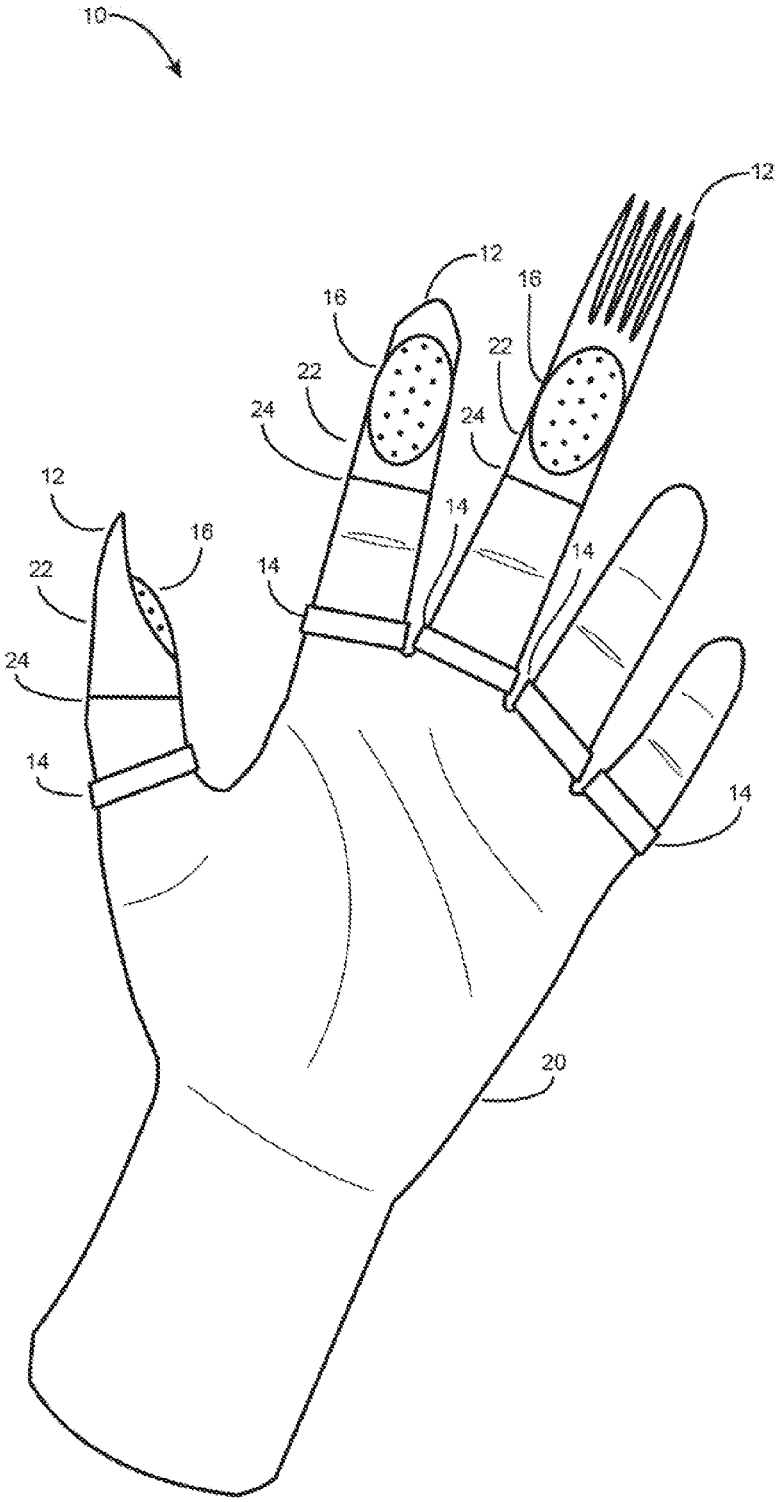
FIG. 7 is a bottom perspective view of a device embodying the principles of the invention.

As set forth above, FIG. 6 is a cross-section perspective view of a device embodying the principles of the invention.

In an exemplary embodiment, glove 10 may be comprised of dual layers of material. Inner layer 26 may be attached to cutting element 12 at the distal terminus of the digital portion of glove 10. As way of illustration, without limiting the invention, inner layer 26 and cutting element 12 may be attached by adhesive, screwing, snapping or fashioned otherwise during the manufacturing process.

Outer layer 28 covers inner layer 26 and partially encloses cutting element 12 at the proximal base leaving the sharp distal edge of cutting element 12 exposed. Outer layer 28 may be attached to inner layer 26 and cutting element 12 in a variety of methods, for example, without limiting the invention, adhesive, screwing, snapping or fashioned during the manufacturing process. In the preferred embodiment, inner layer 26 may be fashioned to outer layer 26 and cutting element 12 during the manufacturing process.

In an alternative embodiment, glove 10 may be comprised of a single layer of material where cutting element 12 is attached to glove 10. Cutting element 12 may be attached to glove 10 by adhesive, screwing, snapping or fashioned during the manufacturing process.

A device for meat preparation has been described. The foregoing description of the various exemplary embodiments of the invention has been presented for the purposes of illustration and disclosure. It is not intended to be exhaustive or to limit the invention to the precise form disclosed. Many modifications and variations are possible in light of the above teaching. It is intended that the scope of the invention not be limited by this detailed description, but by the claims and the equivalents to the claims.

What is claimed:

1. A glove for meat preparation comprising:

a glove body configured to enclose a dorsal area and a palmar area of a hand and configured to extend over a length of a forearm;

a plurality of finger bodies extending out from the glove body and configured to enclose each finger of the hand;

a thumb body configured to enclose a thumb of the hand;

a bottom interchangeable cutting element fastened to a distal terminus of the thumb body;

a bottom interchangeable cutting element fastened to a distal terminus of each of the plurality of finger bodies;

a first top interchangeable cutting element with a duck-billed edge attached by a fastener to the bottom interchangeable cutting element of the thumb body;

at least a second top interchangeable cutting element with a tapered edge attached by a fastener to the bottom interchangeable cutting element of one of the plurality of finger bodies;

at least a third top interchangeable cutting element with several tines attached by a fastener to the bottom interchangeable cutting element of another one of the plurality of the finger bodies;

said glove configured to provide protection to the hand of a wearer from meat with a temperature that is too hot to touch.

2. An apparatus for meat preparation comprising:

a glove body configured to enclose a dorsal area and a palmar area of a hand and configured to extend over a length of a forearm;

a plurality of finger bodies extending out from the glove body and configured to enclose each finger of the hand;

a thumb body configured to enclose a thumb of the hand;

a bottom interchangeable cutting element fastened to a distal terminus of the thumb body;

a bottom interchangeable cutting element fastened to a distal terminus of each of the plurality of finger bodies;

a first top interchangeable cutting element with a duck-billed edge attached to the distal terminus by a fastener to the bottom interchangeable cutting element of the thumb body;

at least a second top interchangeable cutting element with a tapered edge attached by a fastener to the bottom interchangeable cutting element of one of the plurality of finger bodies;

at least a third top interchangeable cutting element with several tines attached by a fastener to the bottom interchangeable cutting element of another one of the plurality of finger bodies;

a plastic ring attached at a joint area of the thumb body and each of the plurality of finger bodies and dorsal surface and palmar surface of the glove to maintain an opening into the respective thumb or finger body;

said apparatus configured to provide protection to the hand of a wearer from meat with a temperature that is too hot to touch.

* * * * *